US011543121B1

(12) United States Patent
Davis

(10) Patent No.: US 11,543,121 B1
(45) Date of Patent: Jan. 3, 2023

(54) BURNER HOUSING REMOVAL DEVICE

(71) Applicant: Dragonfire Technologies, Inc., Farmington, NM (US)

(72) Inventor: Ty Freeman Davis, La Plata, NM (US)

(73) Assignee: Dragonfire Technologies, Inc., Farmington, NM (US)

( * ) Notice: Subject to any disclaimer, the term of this patent is extended or adjusted under 35 U.S.C. 154(b) by 136 days.

(21) Appl. No.: 16/436,649

(22) Filed: Jun. 10, 2019

Related U.S. Application Data

(60) Provisional application No. 62/682,441, filed on Jun. 8, 2018.

(51) Int. Cl.
*F23C 5/00* (2006.01)
*F23C 5/08* (2006.01)
*F23C 5/02* (2006.01)

(52) U.S. Cl.
CPC . *F23C 5/08* (2013.01); *F23C 5/02* (2013.01)

(58) Field of Classification Search
CPC ..... F23C 5/08; F23C 5/02; B66C 23/94
See application file for complete search history.

(56) References Cited

U.S. PATENT DOCUMENTS 1,023,438 A * 4/1912 Muncaster ..... B66C 23/94 212/223
6,637,702 B1 * 10/2003 McCandless ..... H02S 30/20 244/172.6
6,726,163 B2 * 4/2004 Eppard ..... A01M 31/025 182/87
2007/0241071 A1 * 10/2007 Antonioni ..... A47F 5/0807 211/87.01
2015/0071790 A1 * 3/2015 Tieke ..... B66C 23/207 416/244 A
2018/0258965 A1 * 9/2018 Danko ..... A63H 33/046
2019/0330031 A1 * 10/2019 Walker ..... B66C 1/12

* cited by examiner

*Primary Examiner* — Steven B McAllister
*Assistant Examiner* — John E Bargero
(74) *Attorney, Agent, or Firm* — Peacock Law P.C.; Philip D. Askenazy

(57) ABSTRACT

An apparatus and method that enables a single person to remove and replace a part, for example a burner housing, from an industrial piece of equipment such as oilfield equipment. A base of the apparatus attaches, either removeably or permanently, to a portion of the equipment such as an exhaust stack, that is above the part. The apparatus has a plurality of arms which swing out from the base, including a beam which is rotated to be aligned with the part. Straps attached to the beam are tightened around the part, and the arms are then extended to remove the part from the equipment.

12 Claims, 11 Drawing Sheets

BURNER HOUSING REMOVAL DEVICE

CROSS-REFERENCE TO RELATED APPLICATIONS

This application claims priority to and the benefit of the filing of U.S. Provisional Patent Application Ser. No. 62/682,441, entitled "Oilfield Separator Burner Housing Removal Device", filed on Jun. 8, 2018. The specification and claims thereof are incorporated herein by reference.

BACKGROUND OF THE INVENTION

Field of the Invention (Technical Field)

The present invention is related to the field of industrial burner systems, specifically to the removal of burner housings, for example burner housings on oilfield separators.

Background Art

Note that the following discussion may refer to a number of publications and references. Discussion of such publications herein is given for more complete background of the scientific principles and is not to be construed as an admission that such publications are prior art for patentability determination purposes.

Industrial burner systems are used in a wide range of applications, for example with oilfield process equipment. This equipment includes fluid separators, line heaters, heat trace boilers, tank heaters, amine units, glycol regenerators and any other equipment that utilize bolt-on burner housings. Oilfield process equipment is typically heated by a piloted burner. The pilot and main burner produce a flame into a burner tube that proceeds into the system's burner tube. The burner tube typically runs the length of the vessel, turns 180 degrees, runs back through the vessel and then exits the vessel. The burner tube then typically becomes vertical and at that point acts as an exhaust stack. Exiting on the same side of the equipment as the burner housing, the vertical structure of the exhaust stack is typically in proximity of the burner housing.

In order to stay functional, industrial burners need periodic maintenance. This maintenance includes the cleaning of soot off the pilot and main burner nozzles as well as out of the burner tube. Furthermore, maintenance can include the removal of any orifice or line obstructions for both the pilot and main burner. Additionally, dust and debris accumulate in the flame arrestor and the burner housing. This dust and debris are carried by air being pulled into the burner housing to feed the burner flame. The resulting accumulation can constrict the flow of air feeding burner flame and thus must be cleaned out. In addition to maintenance, industrial burner systems may also require replacement parts or aftermarket ignition systems that are installed within the burner housing.

The maintenance processes described above require the removal of the burner housing. The burner housing is typically mounted to the burner tube via a flange with an arrangement of nuts and bolts. Burner housings are typically bulky, unbalanced and heavy. In order to remove and reinstall burner housings, two or more technicians are required. Typically, one technician holds the burner housing during the bolting or un-bolting of the flange. Having two or more technicians for this process greatly increases the cost of the maintenance activities described above. Alternatively, truck mounted cranes or other similar equipment can be used to remove burner housings; however, vehicle access to the burner housing can be restricted. Industrial burners, especially oilfield process equipment, can be installed in remote areas, behind retaining walls or within proximity to other equipment making access to the burner housing limited to technicians and light tools.

Accordingly, there is a need for an apparatus that would enable the removal and re-installation of burner housings by only one technician.

SUMMARY OF THE INVENTION (DISCLOSURE OF THE INVENTION)

An embodiment of the present invention is an apparatus for removing a piece of equipment, the apparatus comprising a base for attaching the apparatus to a surface of a first piece of equipment; one or more first arms, a first end of each of the first arms hingeably attached to the base; one or more second arms, a first end of each second arm hingeably attached to a second end of one or more of the one or more first arms; a beam rotatably connected to a second end of one or more of the second arms; and one or more first straps for attaching the beam to a second piece of the equipment below the first piece of the equipment. The center of the beam is preferably rotatably connected to a second end of one or more the second arms. The beam is preferably rotatably connected between the second ends of two second arms. The first end of each of the two second arms is preferably hingeably connected between the second ends of two of the one or more first arms. The first straps are preferably removeably attachable to the beam. The second piece of the equipment preferably comprises a burner housing and the first piece of equipment preferably comprises an exhaust stack. The base is preferably sufficiently high to vertically accommodate all of the first arms when the first arms are vertically arranged. The beam and each arm preferably comprise square or rectangular tubing. The base optionally comprises the same shape as the surface of the first piece of equipment. The apparatus preferably comprises one or more attachments comprising magnets for temporarily attaching the apparatus to the first piece of equipment. Such magnets are preferably hingeably attached to the base. The base preferably comprises one or more attachment points configured to receive straps attaching the base to the first piece of the equipment.

Another embodiment of the present invention is a method for removing a piece of equipment, the method comprising attaching a base of an apparatus to a surface of a first piece of equipment; extending one or more arms of the apparatus, the arms attached to the base; rotating a beam of the apparatus attached to the one or more arms so that it is aligned with a second piece of the equipment that is below the first piece of the equipment; attaching the beam to the second piece of the equipment; and removing the second piece of the equipment. The step of attaching the beam to the second piece of the equipment preferably comprises attaching straps to the second piece of equipment. The method preferably further comprises attaching the straps to the beam. The second piece of equipment is preferably a burner housing. The step of attaching the base to the first piece of equipment preferably comprises attaching a plurality of magnets to the second piece of equipment, the magnets preferably hingeably connected to the base. The first piece of equipment preferably comprises a vertical portion, for example an exhaust stack. The step of attaching the base to the first piece of equipment preferably comprises strapping the base to the vertical portion. The base optionally comprises the same shape as the surface of the first piece of equipment.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate the practice of embodiments of the present invention and, together with the description, serve to explain the principles of the invention. The drawings are only for the purpose of illustrating certain embodiments of the invention and are not to be construed as limiting the invention. In the figures.

DETAILED DESCRIPTION OF EMBODIMENTS OF THE INVENTION

Embodiments of the present invention provides methods and apparatuses for the removal and installation of industrial burner housings or other pieces of equipment. An industrial burner housing removal device (IBHRD) of the present invention is preferably designed in such a way that, when mounted to a vertical beam or any other portion of an apparatus, it provides a wide range of motion in the horizontal plane, relative to gravity, and rigidity in the vertical plane. The range of motion in the horizontal plane is facilitated with one or more mechanical degrees of freedom that preferably provide freedom only in the horizontal plane. With this range of motion in the horizontal plane the apparatus can adjust a beam directly above the burner housing. With two or more straps or linkages the burner housing can then be attached to the beam. Embodiments of the invention preferably includes means for installing the IBHRD onto a vertical exhaust cylindrical beam of the equipment (although the IBHRD can be installed on any portion of the equipment), self-locating means and methods, and means of self-fixation to the vertical cylindrical beam without straps or linkages. The vertical exhaust stack or portion of the equipment to which the IBHRD is to be attached is preferably above and in the vicinity of the burner housing, more preferably within approximately 3.5 feet.

Figure 1:
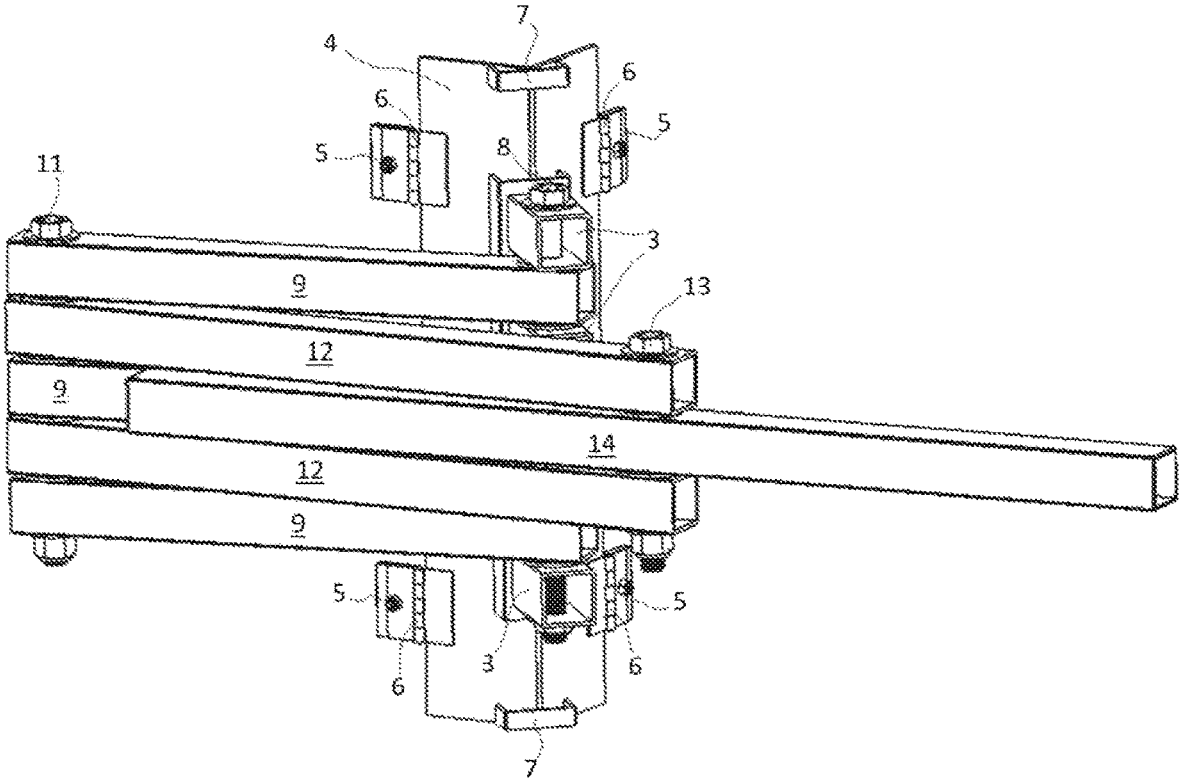
FIG. 1 is the front view of an example embodiment of the invention in a folded position.

The present invention is preferably designed in such a way as to provide a large amount of actuation while remaining in a small footprint when folded for storage. This is best demonstrated in FIG. 1. The modular shape of hinge supports 3, first arms 9, second arms 12, support beam 14, and the space created by the parallel arms preferably enables IBHRD 2 to be folded into a small footprint, as shown more clearly in FIG. 5.

Figure 2:
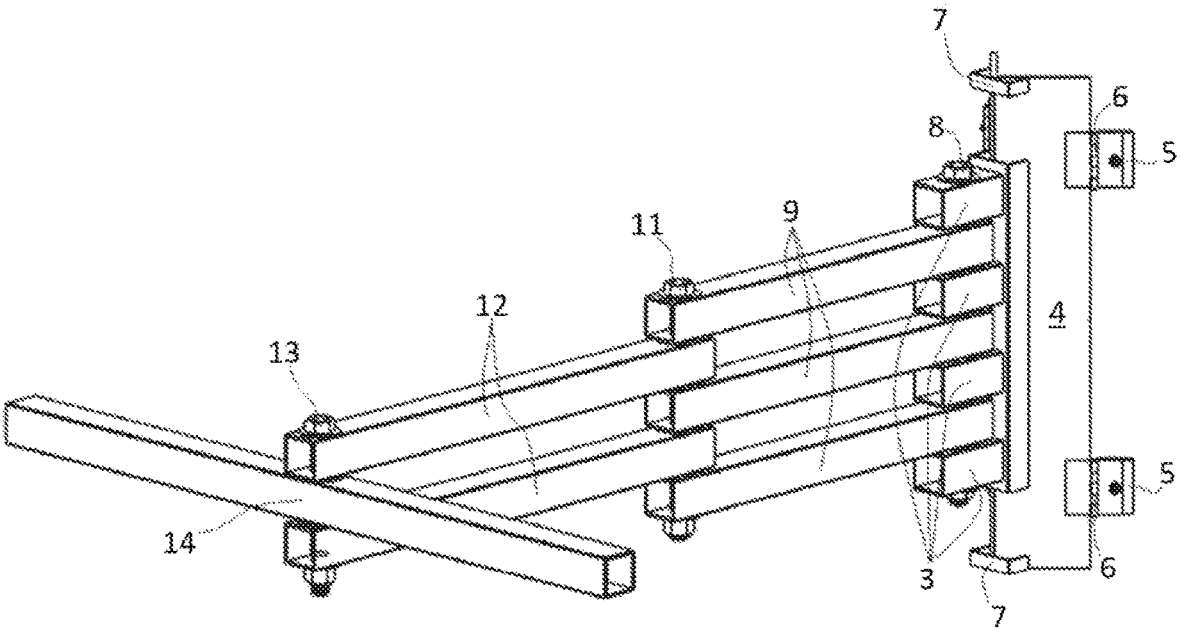
FIG. 2 is the front view of the embodiment of FIG. 1 in an expanded position.

FIG. 2 shows the full extension of IBHRD 2. The angles of first arms 9, second arms 12, and support beam 14 can be varied in any way to position support beam 14 as needed. When base 4 is held fixed, first axle 8 facilitates a rotational degree of freedom about itself for first arms 9. Second axle 11 facilitates a rotational degree of freedom about itself for both first arms 9 and second arms 12. Third axle 13 facilitates a rotational degree of freedom about itself for both second arms 12 and support beam 14. When base 4 is fixed vertically, the device is capable of relatively high loads due to the cumulative torsional and bending strength of arms 9, 12 and support beam 14. These high strengths are preferably achieved by manufacturing the body of arms 9, 12, support beam 14, and optionally hinge supports 3 from thin walled square or rectangular tubing of a high strength alloy. In one embodiment the tubing comprises plain carbon steel and has a cross sectional width of 1.5 inches and a wall thickness of 0.1 inch. The load of the burner housing is transmitted first through third axle 13 then to second axle 11 and first axle 8 and finally from base 4 to the preferably vertical structure that IBHRD 2 is connected to. The preferably vertical and wide stance of base 4 helps to lessen the resulting force experienced at top strap connection 7 and top strap 15, shown in FIG. 8, which counteracts the moment caused by the load.

Figure 3:
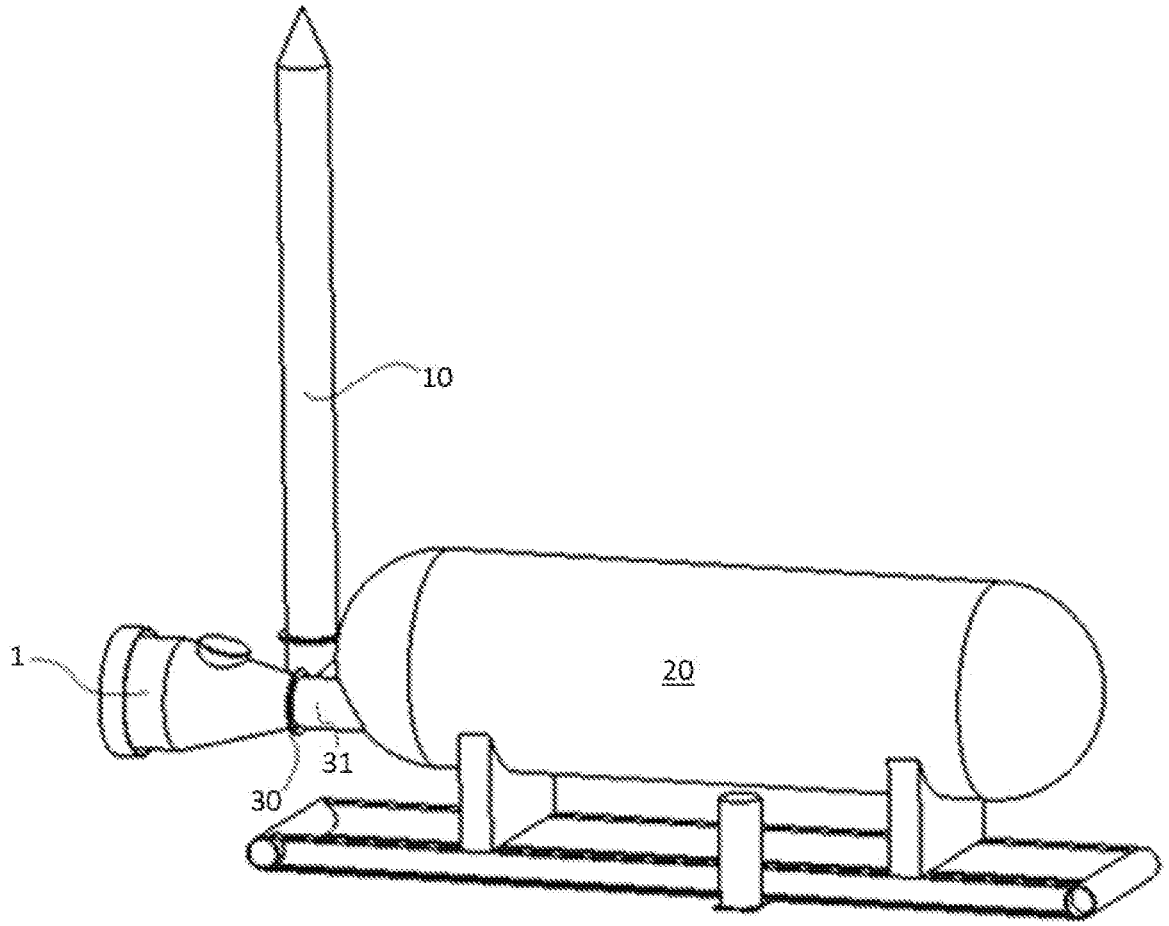
PRIOR ART FIG. 3
FIG. 3 is an isometric view of typical oilfield process equipment.
Figure 4:
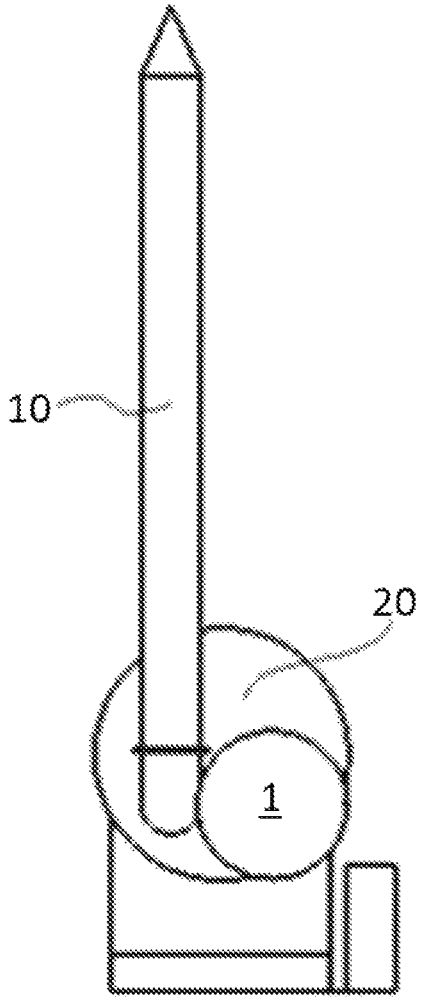
PRIOR ART FIG. 4
FIG. 4 is a front view of the equipment shown in FIG. 3.

FIG. 3 shows an example of oilfield process equipment. Body 20 of the equipment typically has a burner tube 31 running the length of the body 20 that makes a 180 degree turn and then exits on the same side as the burner housing 1. Burner tube 31 then turns vertically and is flanged to or is used as exhaust stack 10. Burner housing 1 typically attaches to burner tube 31 via bolting through flange 30. FIG. 4 depicts the front view of the equipment, showing the proximity of exhaust stack 10 and burner housing 1.

Figure 5:
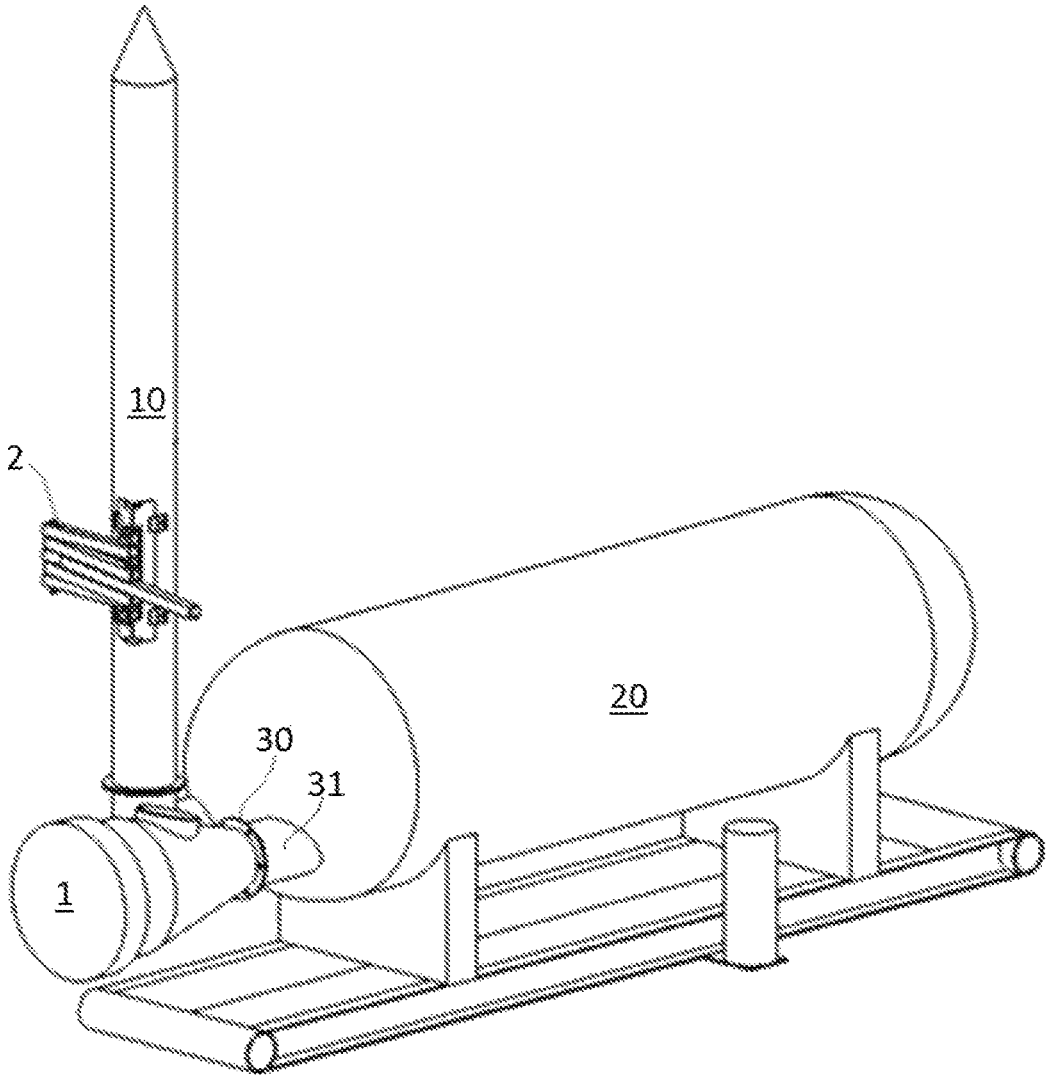
FIG. 5 shows an example embodiment of the invention mounted to the vertical stack of the equipment shown in FIG. 3.
Figure 6:
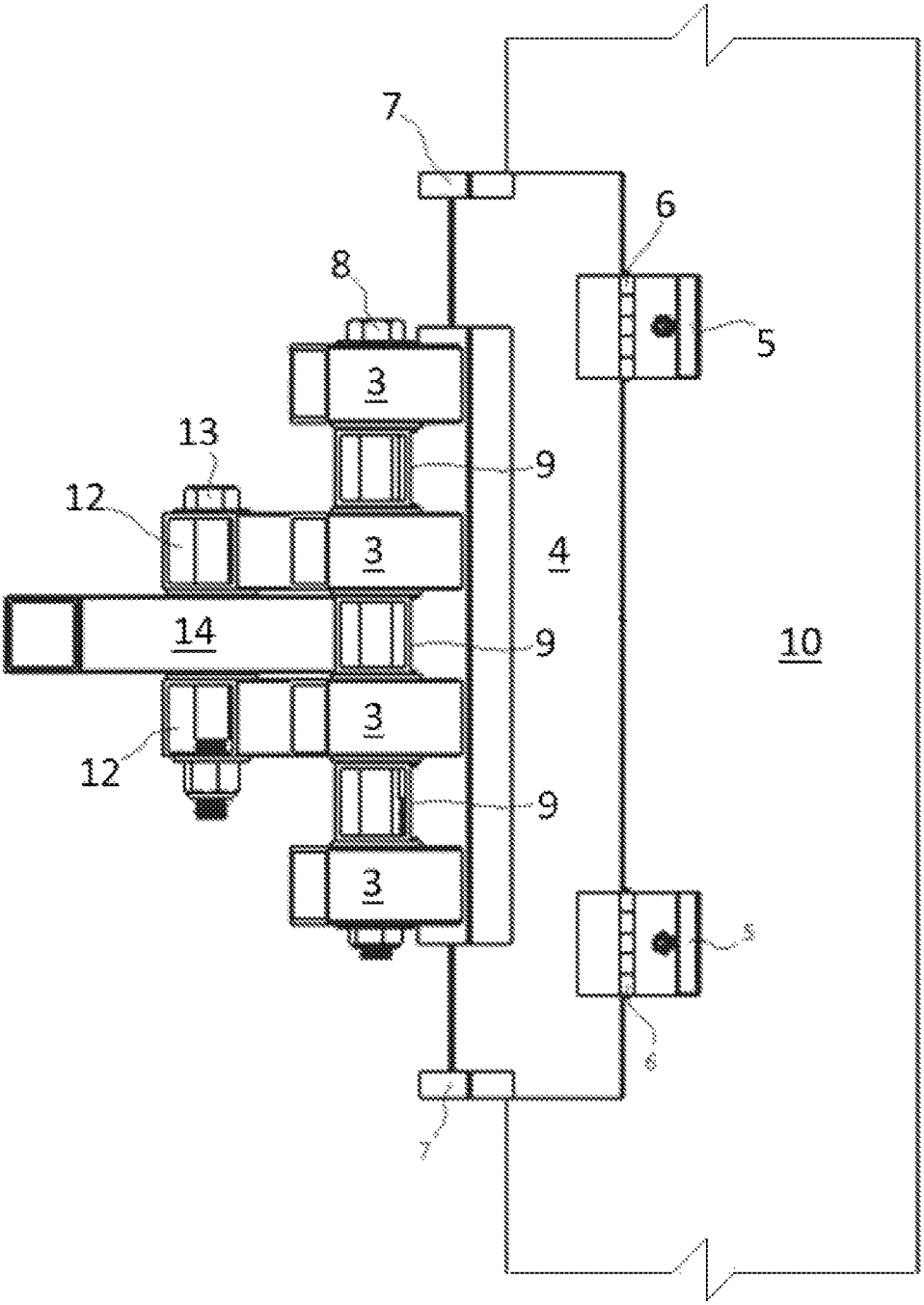
FIG. 6 is an enlarged side view of FIG. 5.

FIG. 5 shows the first step of mounting the IBHRD 2 to the exhaust stack 10 of the industrial burner system. The IBHRD 2 is preferably placed on the exhaust stack 10 in the folded position to keep the mass of the device as close to the exhaust stack 10 as possible. This process reduces the reduces the moment at the interface between base 4 and exhaust stack 10. FIG. 6 gives a closer perspective of the first step of mounting in the IBHRD. Magnets 5 are preferably attached to base 4 via hinges 6. When IBHRD 2 is initially placed on exhaust stack 10, magnets 5 preferably rotate on hinges 6 until they meet exhaust stack 10. Once in contact, magnets 5 preferably are strong enough to hold IBHRD 2 onto exhaust stack 10 long enough to facilitate a single technician placing IBHRD 2 against exhaust stack 10 and strapping IBHRD 2 to exhaust stack 10 by connecting straps 15 from strap connections 7 around exhaust stack 10 and back to strap connections 7. The mounting of magnets 5 on hinges 6 ensures the best possible interface between magnets 5 and exhaust stack 10, regardless of the exhaust stack 10 diameter. In addition, hinge-mounted magnets 5 preferably ensure that the inside faces of base 4 lie flush against, and maximize their contact area with, exhaust stack 10 so that any loads experienced by IBHRD 2 are distributed evenly across the interface without point loads, thereby greatly reducing the risk of damaging exhaust stack 10. Although this attachment scheme enables IBHRD 2 to be removable from exhaust stack 10, in other embodiments IBHRD 2 may be mounted permanently on exhaust stack 10 (or any other part of the industrial or oilfield equipment) using any suitable attachment known in the art.

Figure 7:
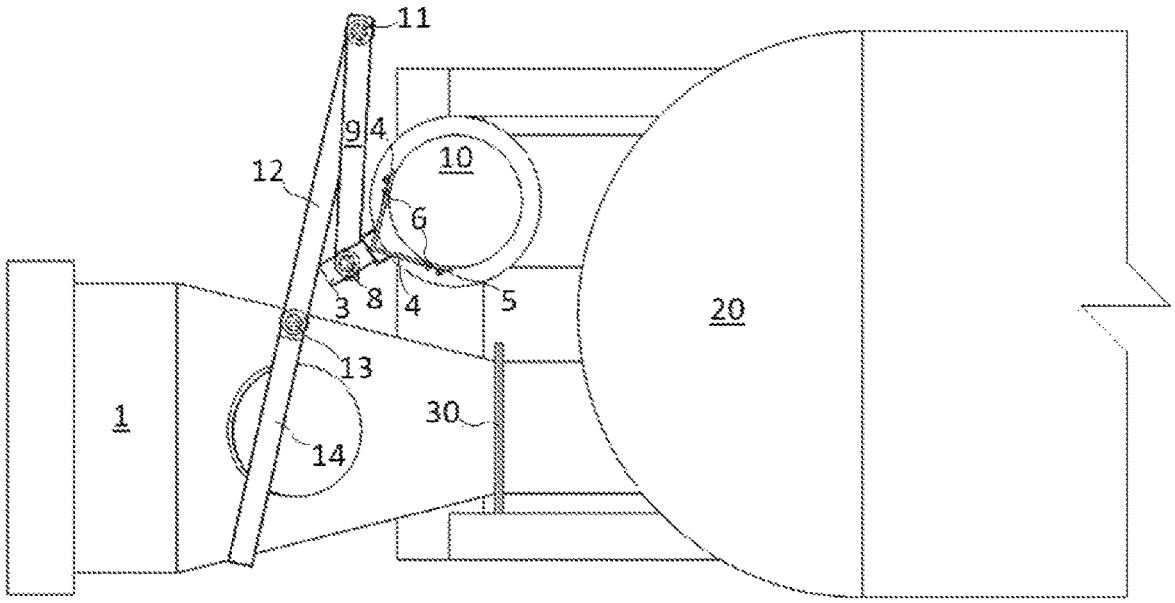
FIG. 7 is a top view showing the embodiment of the invention partially extended.

FIG. 7 shows a top view of IBHRD 2 mounted to exhaust stack 10. From this view the interface between magnets 5 and exhaust stack 10 is more clearly shown. The angular nature of base 4 is also shown from this view. Once strapped and loaded, the tension on the straps will be reduced as there are two linear points of contact on the inner faces of base 4 to counteract some of the torsion on IBHRD 2. In embodiments where the diameter of exhaust stack 10 is known, rather than comprising angular plates, base 4 may be semi-cylindrical, having an inner radius that matches the outer radius of exhaust stack 10 (or otherwise conform more exactly to the shape of the piece of equipment it is being attached to), thus increasing the contact area (and reducing the load at each point on exhaust stack 10) further.

Figure 8:
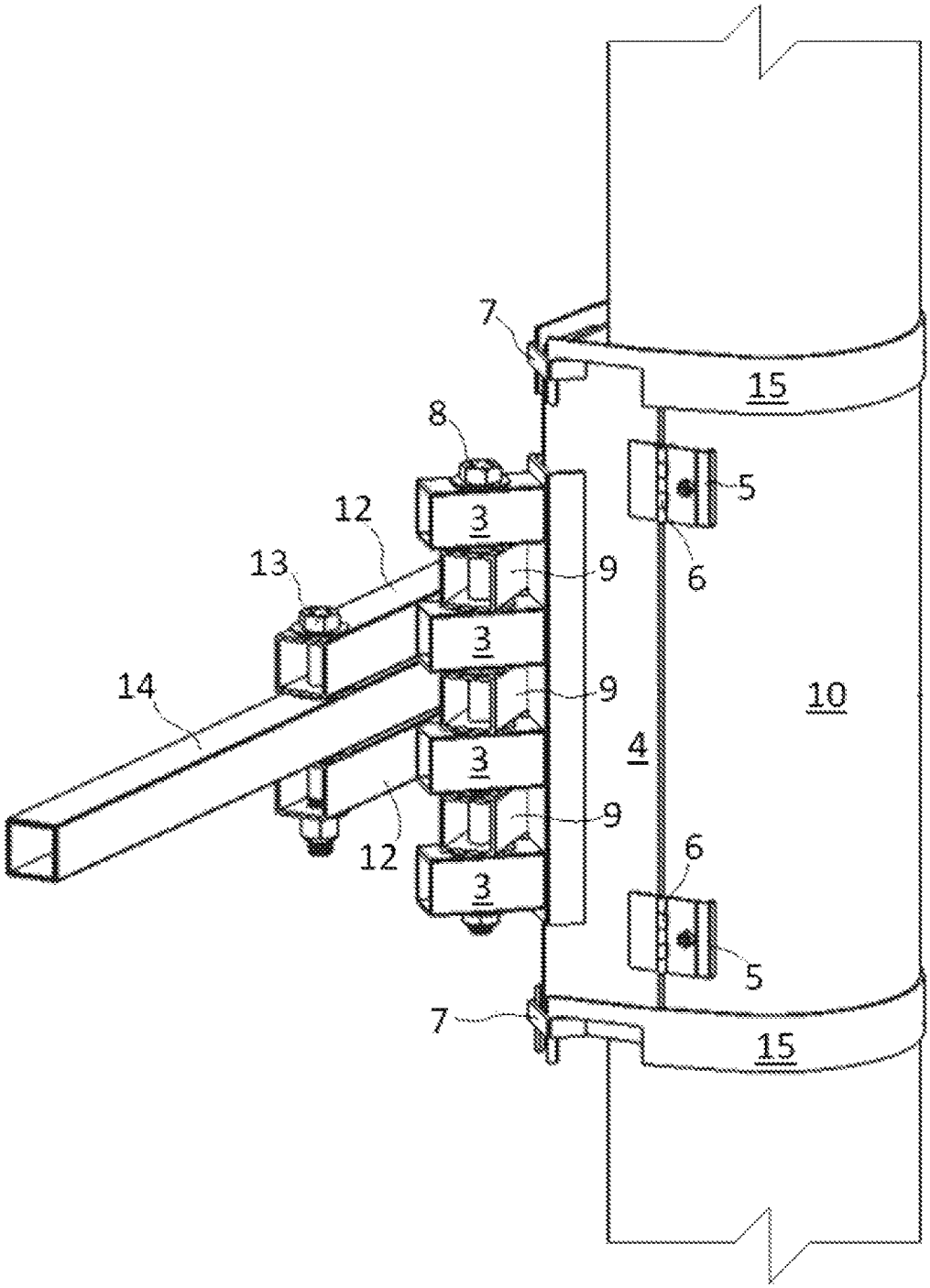
FIG. 8 is a side view of FIG. 7.

FIG. 8 shows an enlarged view of IBHRD 2 mounted to exhaust stack 10 secured by straps 15. Straps 15 are preferably attached to both the top and bottom strap connections 7 and preferably tightened around the backside of the exhaust stack 10. Straps 15 may comprise any material with enough tensile strength to withstand the loads on the IBHRD and can be tightened via any means, including but not limited to ratchet strapping methods.

Figure 9:
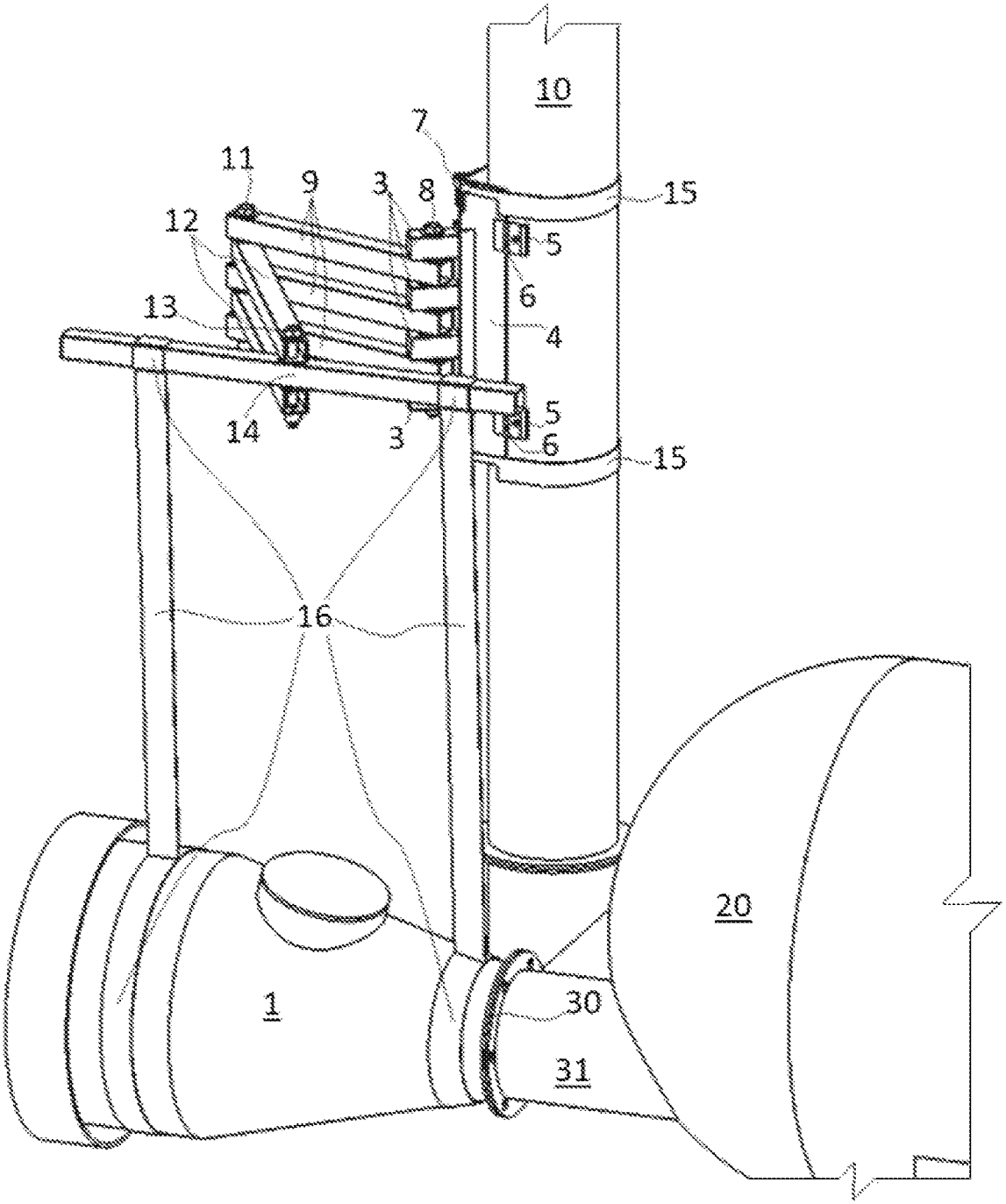
FIG. 9 shows an arm or beam of the example embodiment of the invention strapped to the burner housing.
Figure 10:
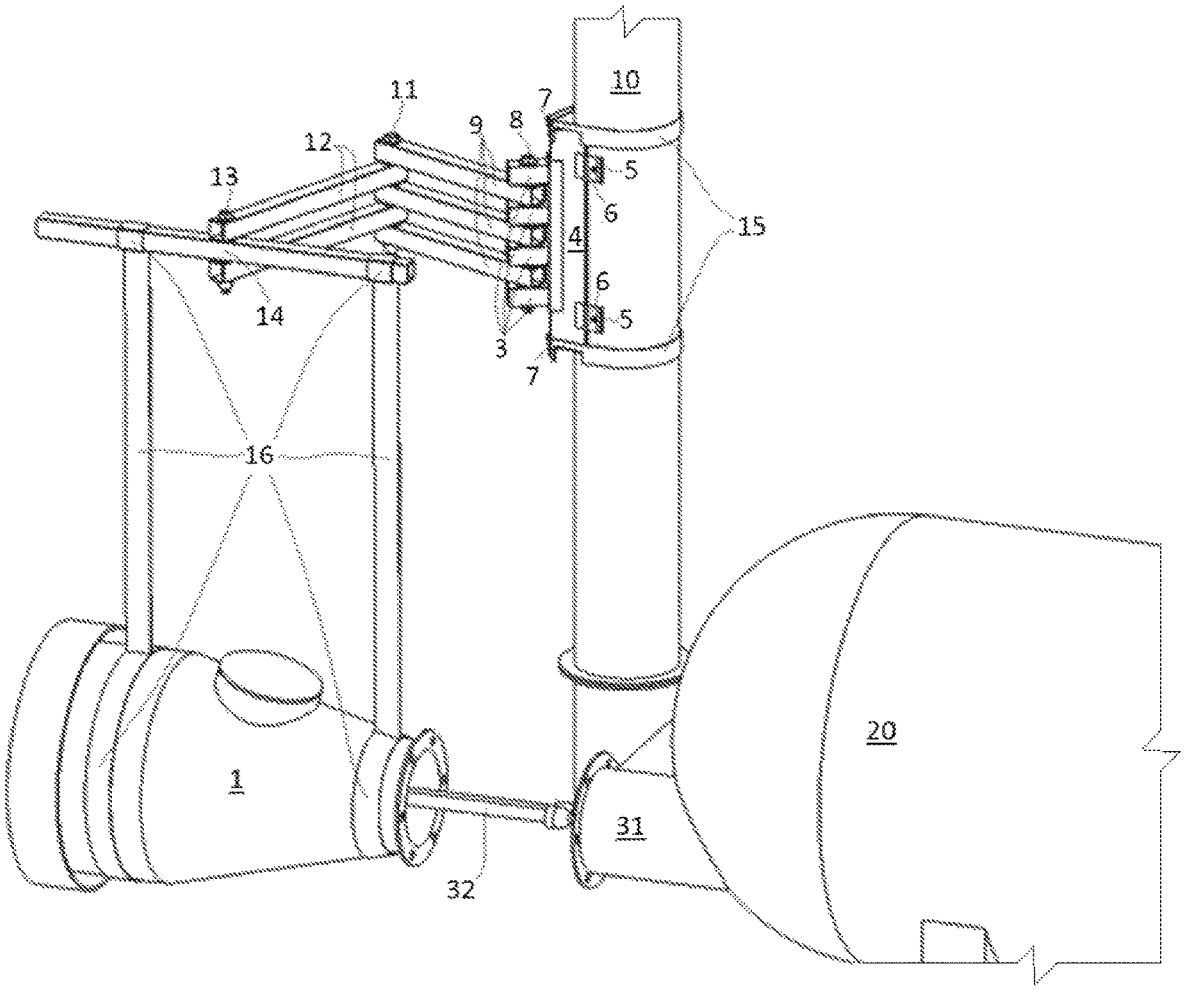
FIG. 10 shows the example embodiment of the invention during the removal of the burner housing.

FIG. 9 illustrates IBHRD 2 secured to exhaust stack 10 with support beam 14 positioned directly above, and preferably parallel to the axis of, burner housing 1. Support beam 14 is preferably connected to the burner housing 1 using burner housing straps 16. These burner housing straps 16 can be placed anywhere on the support beam 14 that balances the mass of the burner housing 1. Burner housing straps 16 are preferably removable from both burner housing 1 and support beam 14, although in some embodiments burner housing straps 16 may be permanently affixed to support beam 14. Whether or not burner housing straps 16 are permanently affixed to support beam 14, the size opening in the end of each strap through which support beam 14 is inserted may either be adjustable and tightenable, or alternatively sewn or otherwise fixed to the appropriate size to accommodate the cross section size of support beam 14. Once burner housing straps 16 are sufficiently tightened around the outer diameter of burner housing 1 and the mass of burner housing 1 is supported by IBHRD 2, the bolts mounting the burner housing 1 to the burner tube 31 via flange 30 can be removed. Burner housing 1 and burner assemblies 32 can then be easily removed from burner tube 31, as shown in FIG. 10, by extending the arms away from base 4. IBHRD 2 preferably supports the burner housing and facilitates the positioning of it anywhere within the IBHRD's full extension radius.

During reinstallation, IBHRD 2 can be used to place the aperture of burner housing 1 concentric with burner tube 31, aiding in the insertion of the burner assemblies 32, burner mounted igniters if used, and the flange mounting bolts. This eliminates all lifting done traditionally by technicians.

Nylon washers or any other friction reducing devices can be added to first axle 8 between each connection linkage 3 and the adjoining arm 9, to second axle 11 between each arm 9 and the adjoining arm 12, and/or to third axle 13 between each arm 12 and support beam 14. These devices lower the force required to the move supported burner housing 1 and lower the wear on the linkage and arm interfaces.

Figure 11:
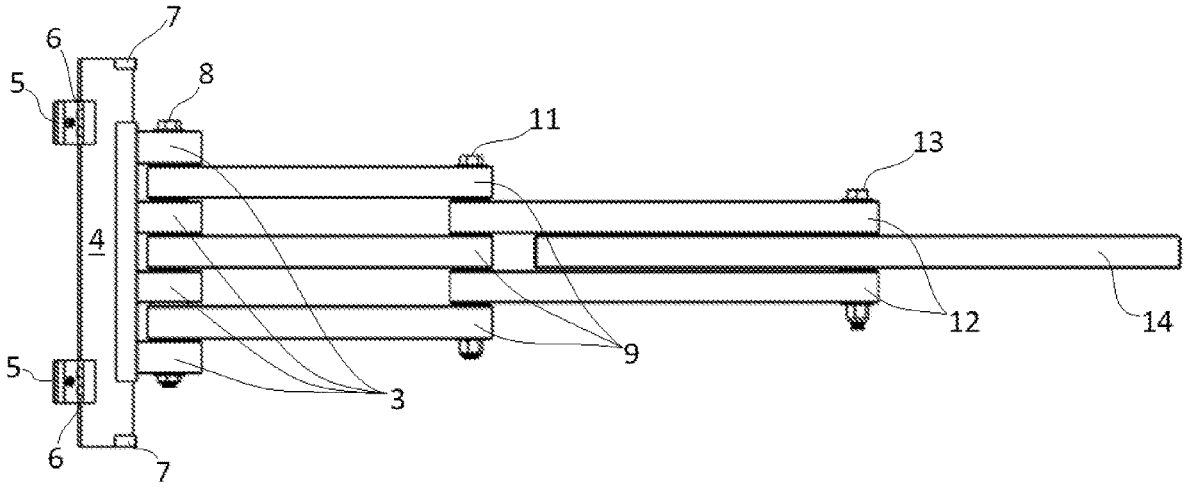
FIG. 11 shows example dimensions of one embodiment of the present invention.

Although any dimensions of base 4, hinge supports 3, first arms 9, second arms 12, and support beam 14 may be used, the dimensions of the embodiment shown in FIG. 11 are as follows: base 4 is 18 inches high, hinge supports 3 are each 3 inches long, first arms 9 are each 16 inches long, second arms 12 are each 20 inches long, and support beam 14 is 30 inches long. The height of each of hinge supports 3, first arms 9, second arms 12, and support beam 14 is 1.5 inches. This embodiment is particularly useful for removing and reinstalling burner housings from oilfield equipment. This embodiment weighs approximately 30 pounds, and is able to remove and can optimally reinstall burners that range from about 30 pounds to about 50 pounds, although it can be used on burner housings as heavy as 200 pounds. Although in FIG. 11 hinge supports 3, first arms 9, second arms 12, and support beam 14 are shown as all having the same cross sectional width, in some embodiments different cross sectional widths for the different elements may be used. For example, first arms 9 may be larger in width than second arms 12.

Note that in the specification and claims, "about" or "approximately" means within twenty percent (20%) of the numerical amount cited. As used herein, the singular forms "a," "an," and "the" include plural referents unless the context clearly dictates otherwise. Thus, for example, reference to "a functional group" refers to one or more functional groups, and reference to "the method" includes reference to equivalent steps and methods that would be understood and appreciated by those skilled in the art, and so forth.

Although the invention has been described in detail with particular reference to the disclosed embodiments, other embodiments can achieve the same results. Variations and modifications of the present invention will be obvious to those skilled in the art and it is intended to cover all such modifications and equivalents. The entire disclosures of all patents and publications cited above are hereby incorporated by reference.

What is claimed is:

1. A method for removing a removable piece of equipment, the method comprising:

attaching an angular base of an apparatus to a rounded or cylindrical surface of a first piece of equipment;

extending a plurality of arms of the apparatus, the arms connected to the base;

rotating a beam of the apparatus connected to the plurality of arms at approximately its longitudinal center so that it is aligned with a removable piece of the equipment that is below the first piece of the equipment;

attaching the beam to the removable piece of the equipment; and removing the removable piece of the equipment.

2. The method of claim 1 wherein the step of attaching the beam to the removable piece of the equipment comprises attaching straps to the second piece of equipment.

3. The method of claim 2 further comprising attaching the straps to the beam.

4. The method of claim 1 wherein the removable piece of equipment is a burner housing.

5. The method of claim 1 wherein the step of attaching the base to the first piece of equipment comprises attaching a plurality of magnets to the removable piece of equipment, the magnets connected to the base.

6. The method of claim 1 wherein the first piece of equipment comprises a vertical portion.

7. The method of claim 6 wherein the step of attaching the base to the first piece of equipment comprises strapping the base to the vertical portion.

8. The method of claim 6 wherein the vertical portion comprises an exhaust stack.

9. The method of claim 2 comprising:

attaching one strap both to a first position of the beam, the first position on a first side of the longitudinal center of the beam, and to a first location on the removable piece of equipment; and attaching a second strap both to a second position of the beam, the second position on a side of the longitudinal center of the beam opposite to the first side, and to a second location on the removable piece of equipment.

10. The method of claim 5 wherein the magnets are hingeably connected to the base.

11. The method of claim 1 wherein the angular base comprises a 90° angle.

12. The method of claim 1 wherein extending the plurality of arms comprises extending a plurality of individual first arms, a first end of each of the first arms hingeably connected to the base; and extending a plurality of individual second arms, a first end of each second arm hingeably connected between the second ends of two of the one or more first arms; wherein the beam is rotatably connected at approximately its longitudinal center between the second ends of two of said second arms.

* * * * *